US009414725B2

(12) United States Patent
Streciwilk et al.

(10) Patent No.: US 9,414,725 B2
(45) Date of Patent: Aug. 16, 2016

(54) UPRIGHT VACUUM CLEANER WITH TWO AUXILIARY OPERATING MODES

(71) Applicant: Panasonic Corporation of North America, Secaucus, NJ (US)

(72) Inventors: Eric John Streciwilk, Danville, KY (US); Joseph Blue Wofford, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 80 days.

(21) Appl. No.: 14/561,951

(22) Filed: Dec. 5, 2014

(65) Prior Publication Data

US 2016/0157688 A1 Jun. 9, 2016

(51) Int. Cl.

| | |
|---|---|
| ***A47L 5/32*** | (2006.01) |
| ***A47L 9/24*** | (2006.01) |
| ***A47L 5/30*** | (2006.01) |
| ***A47L 5/22*** | (2006.01) |
| ***A47L 9/32*** | (2006.01) |

(52) U.S. Cl.

CPC . *A47L 5/30* (2013.01); *A47L 5/225* (2013.01); *A47L 5/32* (2013.01); *A47L 9/325* (2013.01)

(58) Field of Classification Search

CPC ..... A47L 5/30; A47L 5/225; A47L 5/32; A47L 9/325

See application file for complete search history.

(56) References Cited

U.S. PATENT DOCUMENTS

| | | | |
|---|---|---|---|
| 2,867,833 | A | 1/1959 | Duff |
| 4,309,048 | A | 1/1982 | Ahlf et al. |
| 4,700,429 | A | 10/1987 | Martin et al. |
| 5,125,127 | A | 6/1992 | Bach et al. |
| 6,519,810 | B2 | 2/2003 | Kim |
| 6,991,262 | B1 | 1/2006 | Ragner |
| 7,131,164 | B2 | 11/2006 | Uratani et al. |
| 7,356,876 | B2 | 4/2008 | Dant et al. |
| 7,503,098 | B2 | 3/2009 | Stein |
| 7,581,286 | B2 | 9/2009 | Choi |
| 7,650,668 | B2 | 1/2010 | Kim |
| 7,770,257 | B2 | 8/2010 | Kim |
| 7,877,837 | B2 | 2/2011 | Gammack et al. |
| 7,979,953 | B2 | 7/2011 | Yoo |
| 8,042,224 | B2 | 10/2011 | White et al. |
| 8,061,044 | B2 | 11/2011 | Saitoh |
| 8,108,967 | B2 | 2/2012 | Wood |
| 8,225,456 | B2 | 7/2012 | Hakan et al. |
| 8,225,457 | B2 | 7/2012 | Sanderson et al. |
| 8,240,003 | B2 | 8/2012 | Gammack et al. |
| 8,302,251 | B2 | 11/2012 | Beskow et al. |
| 8,424,151 | B2 * | 4/2013 | Lee ..... A47L 5/30 15/319 |
| 8,438,697 | B2 | 5/2013 | Kim et al. |
| 8,468,646 | B2 | 6/2013 | Yoo |

(Continued)

*Primary Examiner* — Dung Van Nguyen
(74) *Attorney, Agent, or Firm* — King & Schickli, PLLC

(57) ABSTRACT

An upright vacuum cleaner includes a body. A dirt collection vessel and a suction generator are carried on the body. A cleaning wand is releasably held in a home position on the body. A supplemental cleaning tool is attached to the distal end of the cleaning wand when the cleaning wand is in the home position. The upright vacuum cleaner includes a first auxiliary operating mode wherein the cleaning wand and supplemental cleaning tool are removed together from the home position for use in a cleaning application and a second auxiliary operating mode wherein a cleaning wand is removed from the home position for use in the cleaning application and the supplemental cleaning tool is retained in the home position. Either auxiliary operating mode may be adopted without handling the supplemental cleaning tool.

20 Claims, 20 Drawing Sheets

(56) References Cited

U.S. PATENT DOCUMENTS

| | | | | |
|---|---|---|---|---|
| 8,561,255 | B2 | 10/2013 | Seo et al. | |
| 8,720,002 | B2 | 5/2014 | Gammack et al. | |
| 8,800,103 | B2 * | 8/2014 | Hong | A47L 5/32 15/323 |
| 8,959,706 | B2 * | 2/2015 | Park | A47L 5/225 15/323 |
| 2008/0040883 | A1 | 2/2008 | Beskow et al. | |
| 2009/0217483 | A1 | 9/2009 | Lee et al. | |
| 2011/0173771 | A1 | 7/2011 | Park et al. | |
| 2013/0081225 | A1 | 4/2013 | Mcluckie et al. | |

* cited by examiner

UPRIGHT VACUUM CLEANER WITH TWO AUXILIARY OPERATING MODES

TECHNICAL FIELD

This document relates generally to the floor care equipment field and, more particularly, to an upright vacuum cleaner incorporating a wand and a supplemental cleaning tool that are easily configured for operating in two different auxiliary operating modes.

BACKGROUND

It is known in the art to equip upright vacuum cleaners with a flexible hose and a wand assembly. Typically such vacuum cleaners incorporate supplemental cleaning tools. In operation, the operator releases the wand assembly from the housing of the upright vacuum cleaner, attaches the supplemental cleaning tool to the wand assembly and then completes the specialized cleaning application such as the above floor cleaning of draperies and upholstery or cleaning under furniture or in tight openings where the necessary clearance for use of the standard nozzle assembly does not exist. After completing the specialty cleaning application, the operator disconnects the supplemental cleaning tool from the wand assembly and returns the wand assembly to its proper position in engagement with the upright vacuum cleaner housing to thereby again allow standard upright vacuum cleaner operation.

Significantly, it should be appreciated that prior art upright vacuum cleaners of this design require the handling of the supplemental cleaning tool when mounting it on and removing it from the wand assembly. Most operators would prefer to not have to handle this cleaning tool as it is perceived as "dirty" whether or not it actually is. This document relates to an upright vacuum cleaner that may be readily configured for operating in two different auxiliary cleaning modes. In the first auxiliary cleaning mode the wand and supplemental cleaning tool are removed together from the handle assembly and air is drawn directly into the supplemental cleaning tool which may be used for a special cleaning application. In the second auxiliary cleaning mode only the wand is removed for the cleaning application and the supplemental cleaning tool remains in its home position on the handle assembly. Either configuration may be adopted without handling the supplemental cleaning tool. This convenient and efficient approach increases the satisfaction of the vacuum cleaner operator.

SUMMARY

In accordance with the purposes and benefits described herein, an upright vacuum cleaner is provided comprising a body, a dirt collection vessel carried on the body and a suction generator carried on the body. The upright vacuum cleaner further includes a cleaning wand releasably held in a home position on the body. A supplemental cleaning tool is attached to a distal end of the cleaning wand when the cleaning wand is in the home position.

In a first auxiliary operating mode the cleaning wand and supplemental cleaning tool are removed together from the home position for use in a cleaning application. In a second auxiliary operating mode the cleaning wand is removed from the home position for use in a cleaning application and the supplemental cleaning tool is retained in the home position on the body of the vacuum cleaner.

Further describing the vacuum cleaner, the body includes a nozzle assembly connected to a handle assembly. The nozzle assembly includes a suction inlet and in a normal operating configuration air is moved by the suction generator serially through the suction inlet, the supplemental cleaning tool, the cleaning wand and the dirt collection vessel. In contrast, in the first auxiliary operating mode air is moved by the suction generator serially through the supplemental cleaning tool, the cleaning wand and the dirt collection vessel bypassing the suction inlet and the nozzle assembly. In further contrast, in the second auxiliary operating mode air is moved by the suction generator serially through the cleaning wand and the dirt collection vessel bypassing the supplemental cleaning tool and the suction inlet in the nozzle assembly.

The vacuum cleaner further includes a wand release whereby triggering the wand release allows an operator to adopt either of the first auxiliary operating mode or second auxiliary operating mode. The wand release includes a first latch securing the cleaning wand to the body. The first latch includes opposed, spring-loaded latching bolts carried on the cleaning wand and cooperating opposed latching slots on the body.

The wand release includes a first latch release carried on the body. The first latch release includes a spring-loaded actuator and a pivoting cam. Triggering the actuator pivots the cam so as to engage the latching bolts and withdraw the latching bolts from the latching slots thereby releasing the cleaning wand from the home position.

The vacuum cleaner further includes a tool latch securing the supplemental cleaning tool to the distal end the wand. That tool latch includes (a) a latch element pivotally connected to the supplemental cleaning tool and (b) a latch tab on the latch element for engaging a latching notch on the cleaning wand.

In addition, the vacuum cleaner includes a tool latch actuator on the body that engages the latch element and releases the tool latch in the second auxiliary operating mode. In one possible embodiment, the tool latch further includes a resilient clip carried on the body that engages the supplemental cleaning tool when the supplemental cleaning tool is in the home position.

In addition, the body includes a cleaning tool mounting boss upon which the supplemental cleaning tool is held when in the home position. The cleaning tool mounting boss forms a conduit for directing air from the suction inlet in the nozzle assembly to the cleaning wand when the cleaning wand is in the home position. The air directed from the cleaning tool mounting boss to the cleaning wand passes through the supplemental cleaning tool. The cleaning tool mounting boss also includes an open end surrounded by a seal wherein the supplemental cleaning tool includes a suction inlet configured to seat on the open end of the cleaning tool mounting boss with the seal in engagement with the supplemental cleaning tool so as to seal an air pathway between the cleaning tool mounting boss and the supplemental cleaning tool.

In accordance with an additional aspect, a method is provided of selectively operating an upright vacuum cleaner in either of two different auxiliary operating modes where that vacuum cleaner includes a body, a cleaning wand releasably held in a home position on the body and a supplemental cleaning tool attached to a distal end of the cleaning wand when the cleaning wand is in the home position. That method may be broadly described as comprising the steps of triggering a wand release, moving the cleaning wand in a first manner to remove the cleaning wand and supplemental cleaning tool together from the home position for use in a cleaning application or for moving the cleaning wand in a second manner to remove the cleaning wand from the home position for use in a cleaning application while maintaining the supplemental cleaning tool in the home position on the body.

In the following description, there are shown and described several preferred embodiments of the upright vacuum cleaner. As it should be realized, the upright vacuum cleaner is capable of other, different embodiments and its several details are capable of modification in various, obvious aspects all without departing from the upright vacuum cleaner as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the upright vacuum cleaner and together with the description serve to explain certain principles thereof. In the drawing figures:

FIG. 1 is a perspective view of the upright vacuum cleaner in a standard or normal operating configuration.

FIG. 1*a* is a schematic block diagram of the airstream path through the vacuum cleaner when in the normal operating configuration illustrated in FIG. 1.

FIG. 2 is a perspective view of the upright vacuum cleaner in a first auxiliary operating mode wherein the cleaning wand and supplemental cleaning tool are removed together from the body of the vacuum cleaner for use in a cleaning application.

FIG. 2*a* is a schematic block diagram of the airstream path when the vacuum cleaner is configured in the first auxiliary operating mode.

FIG. 3 is a perspective view of the upright vacuum cleaner configured for a second auxiliary operating mode wherein the cleaning wand is removed from the home position for use in a cleaning application and the supplemental cleaning tool is retained in the home position on the body of the vacuum cleaner.

FIG. 3*a* is a schematic block diagram of the airstream path through the vacuum cleaner when configured in the second auxiliary operating mode illustrated in FIG. 3.

Figure 10A:
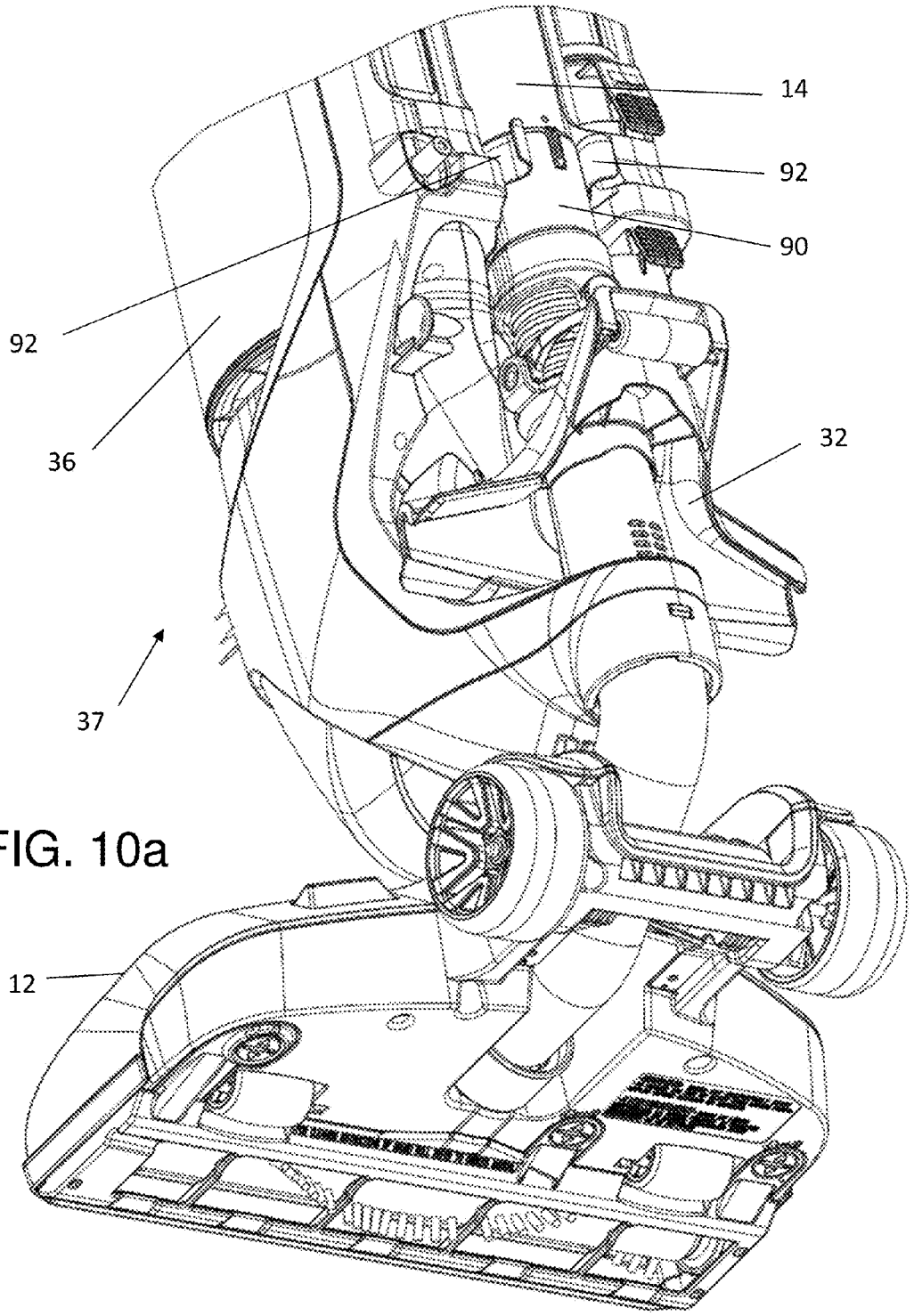

FIG. 10*a* and is a rear perspective view illustrating the wand assembly and supplemental cleaning tool in the home position on the body the vacuum cleaner with the resilient clip engaging the supplemental cleaning tool.

Figure 10B:
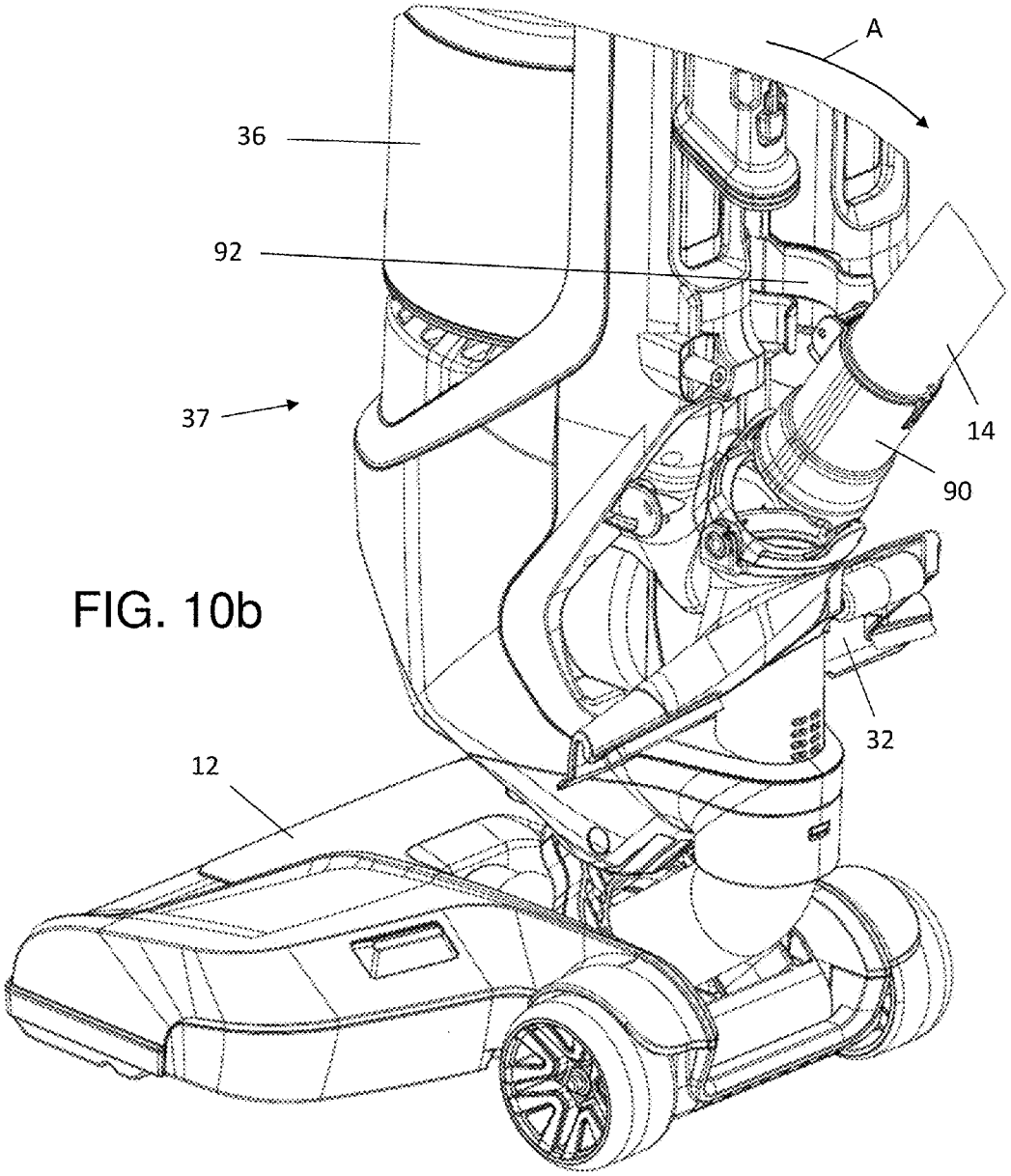

FIG. 10*b* is a rear perspective view illustrating how the wand assembly is pivoted rearwardly to free the supplemental cleaning tool from the resilient clip.

Figure 10C:
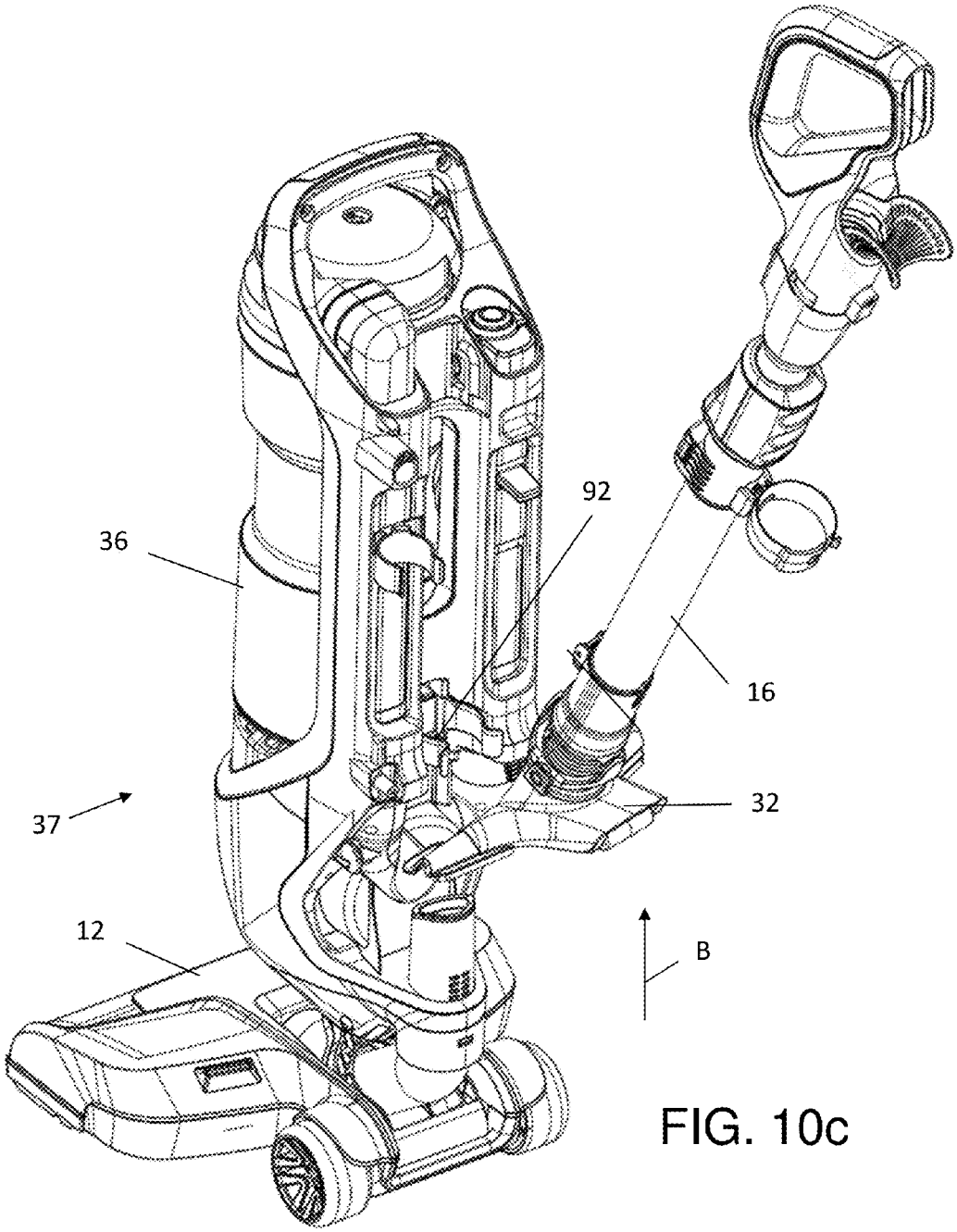

FIG. 10*c* is a rear perspective view showing how the supplemental cleaning tool and wand assembly are then lifted and removed from the body of the vacuum cleaner to operate the vacuum cleaner in the first auxiliary operating mode.

FIGS. 11*a*-11*d* are cross-sectional views illustrating how the wand assembly is moved in a different manner to remove only the cleaning wand from the body of the vacuum cleaner and maintain the supplemental cleaning tool in the home position connected by the resilient clip to the body of the vacuum cleaner to allow operation in the second auxiliary operating mode.

Figure 12:
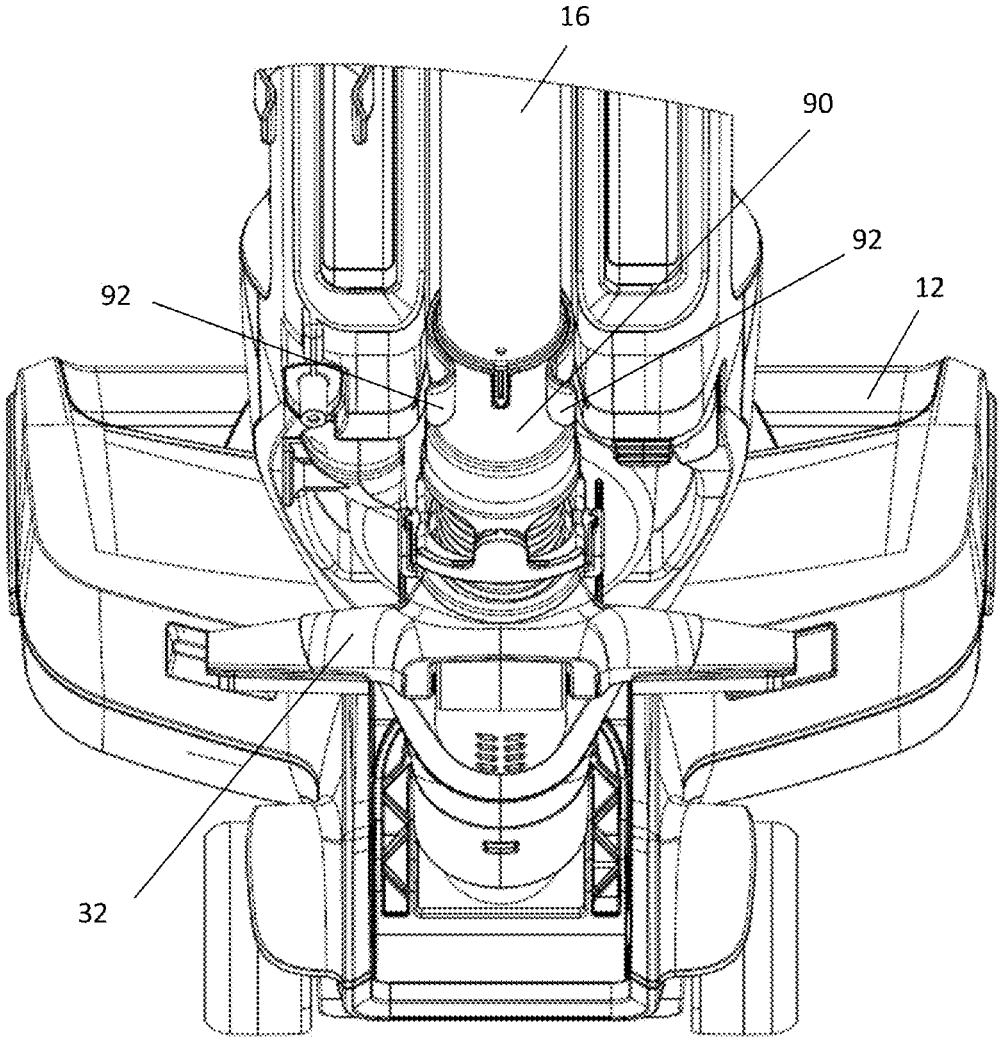

FIG. 12 is a detailed rear perspective view clearly showing the resilient clip that engages the cuff of the supplemental cleaning tool and serves to hold the supplemental cleaning tool in the home position.

Reference will now be made in detail to the present preferred embodiments of the upright vacuum cleaner, examples of which are illustrated in the accompanying drawing figures.

DETAILED DESCRIPTION

Figure 1:
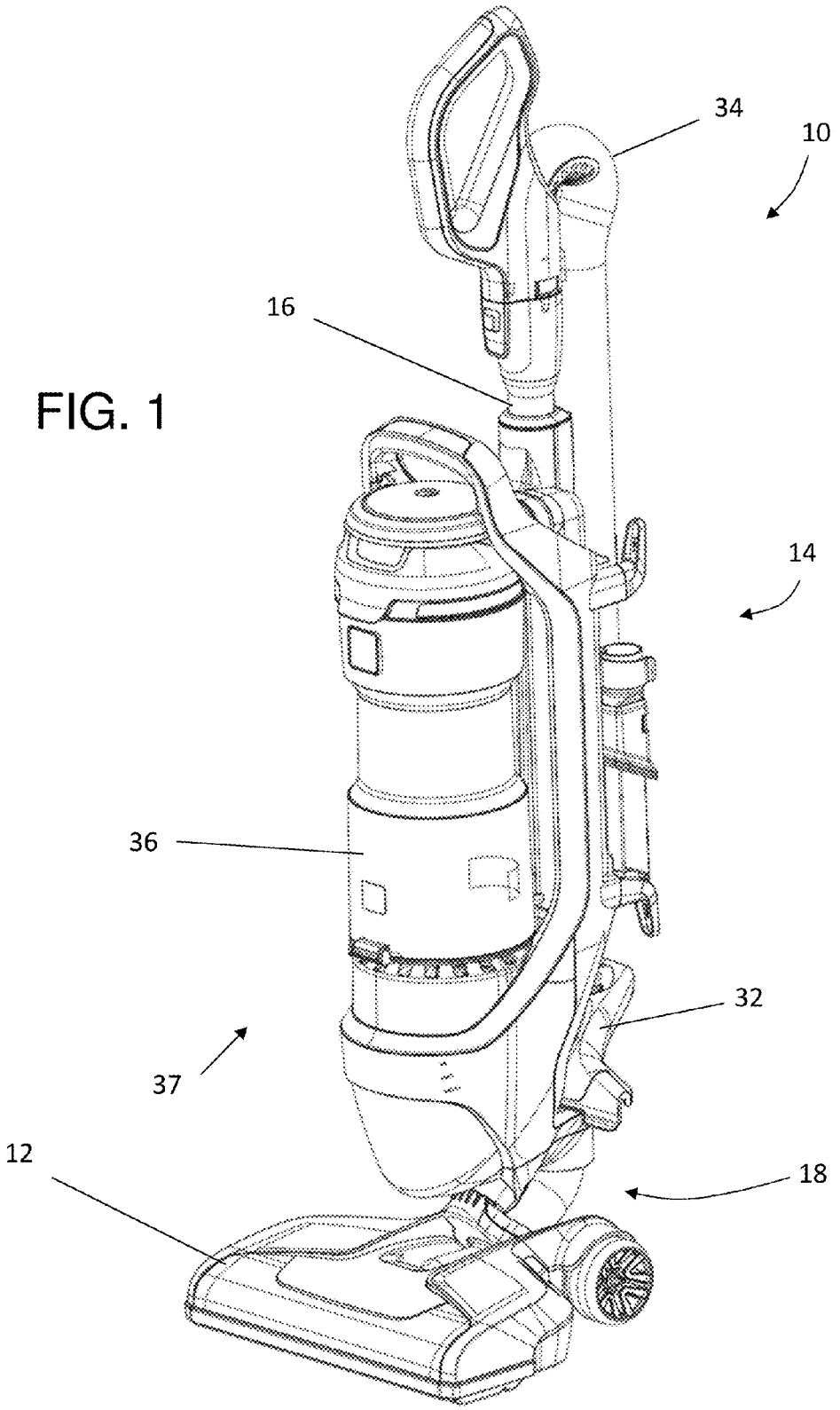
Figure 1A:
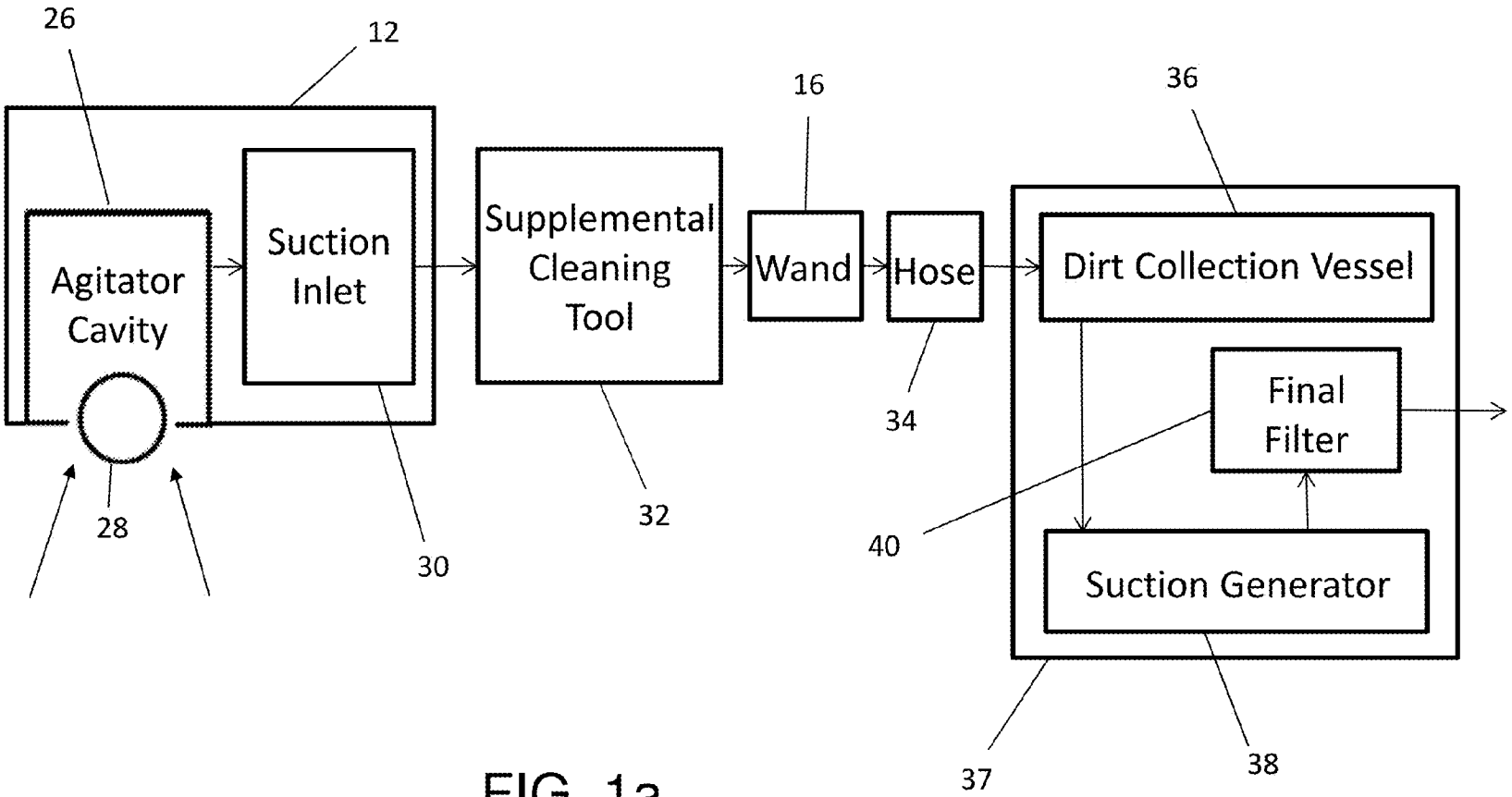

Reference is now made to FIGS. 1 and 1*a*, illustrating the upright vacuum cleaner 10 configured for standard or normal upright vacuum cleaner operation. The upright vacuum cleaner 10 includes a body comprising a nozzle assembly 12, a handle assembly 14 and a swivel connection 18 between the nozzle assembly and the canister assembly.

As schematically illustrated in FIG. 1*a*, the nozzle assembly 12 includes an agitator cavity 26. A rotary agitator 28 is received in the agitator cavity 26. As further illustrated in FIG. 1*a*, dirt and debris is drawn into the agitator cavity 26 and swept by the rotary agitator 28 toward the suction inlet 30. From there the airstream entrained with dirt and debris is drawn through the supplemental cleaning tool 32, a cleaning wand 16 and a flexible hose 34 to the dirt collection vessel 36 on the canister assembly 37.

The dirt collection vessel 36 may comprise an ordinary dirt cup, a cyclonic dirt cup or a vacuum cleaner filter bag. Dirt and debris is removed from the airstream and collected in the dirt collection vessel 36. The relatively clean airstream is then drawn through the suction generator 38 where the airstream provides cooling for the suction generator motor before being forced through the final filter 40 and then returned to the environment.

Figure 2:
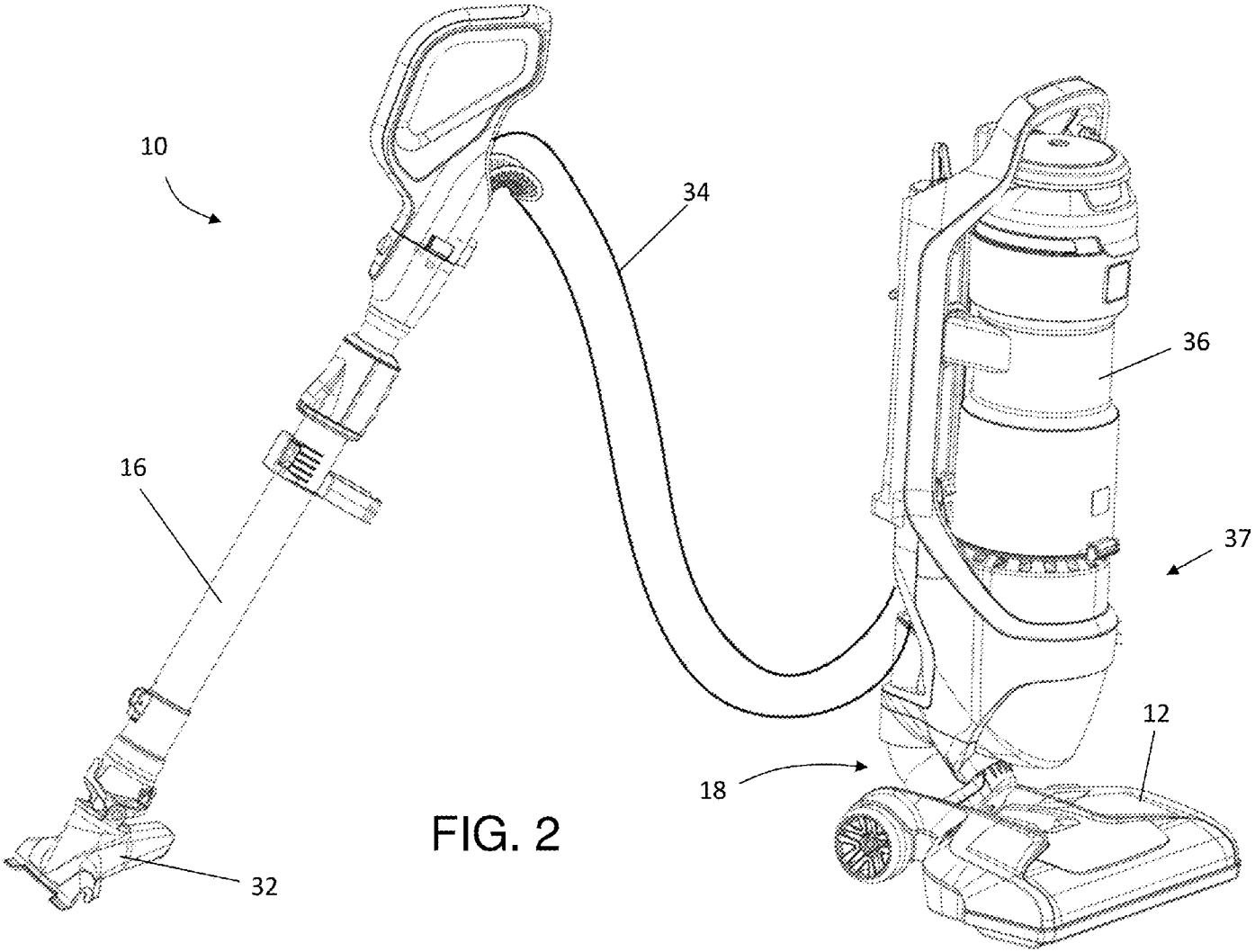
Figure 2A:
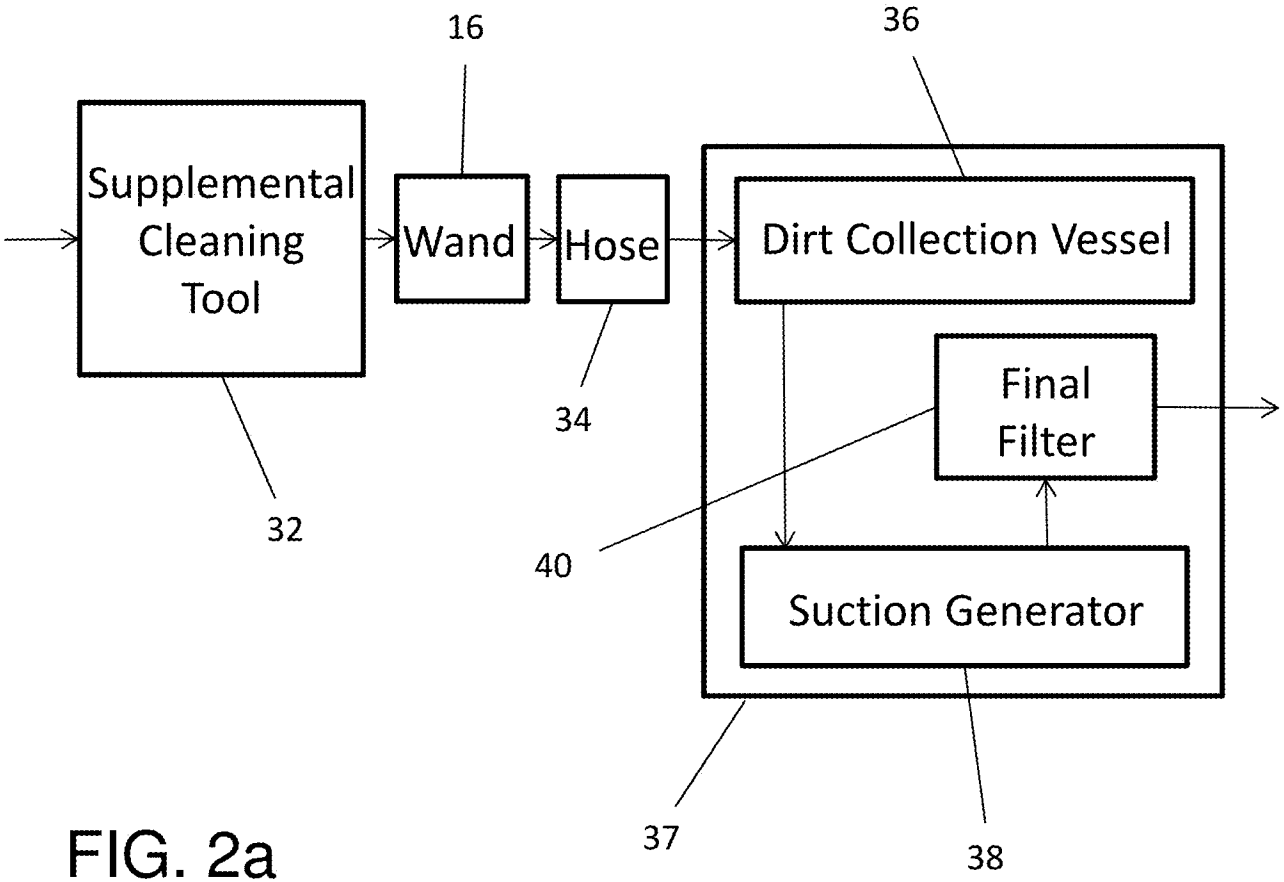

Reference is now made to FIGS. 2 and 2*a* illustrating the upright vacuum cleaner 10 configured for a first auxiliary operating mode. More specifically, the cleaning wand 16 and attached supplemental cleaning tool 32 are removed from their home position on the body of the vacuum cleaner 10 and manipulated by an operator to complete the desired cleaning task in a convenient and efficient manner. This is accomplished without any need to handle the supplemental cleaning tool 32. In this configuration or mode of operation, dirt and debris are drawn directly into the supplemental cleaning tool 32 and then flow downstream through the cleaning wand 16 and the flexible hose 34 to the dirt collection vessel 36. From there the now clean air stream flows through the suction generator 38, cooling the motor, before being forced through the final filter 40 and then returning to the environment.

Figure 3:
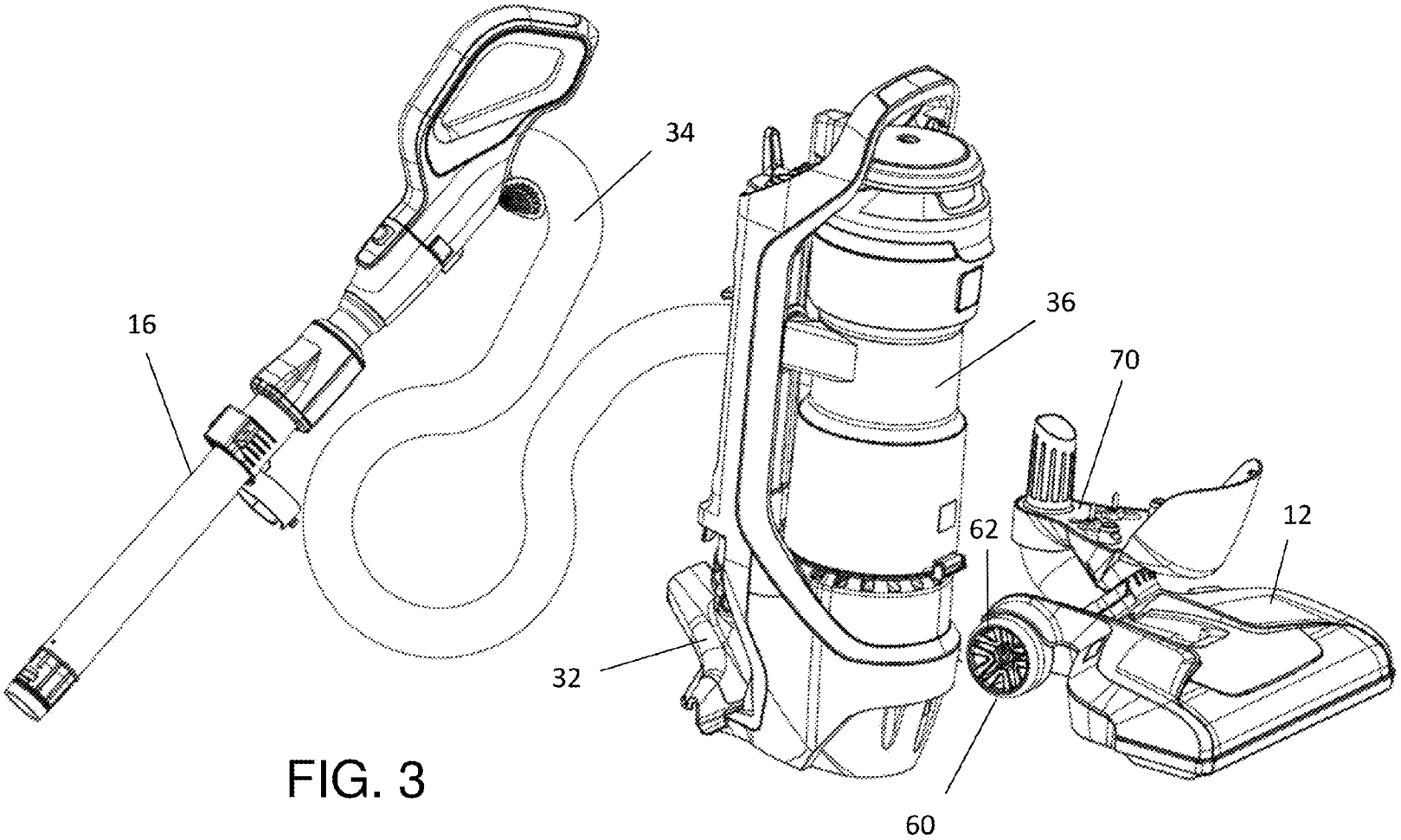
Figure 3A:
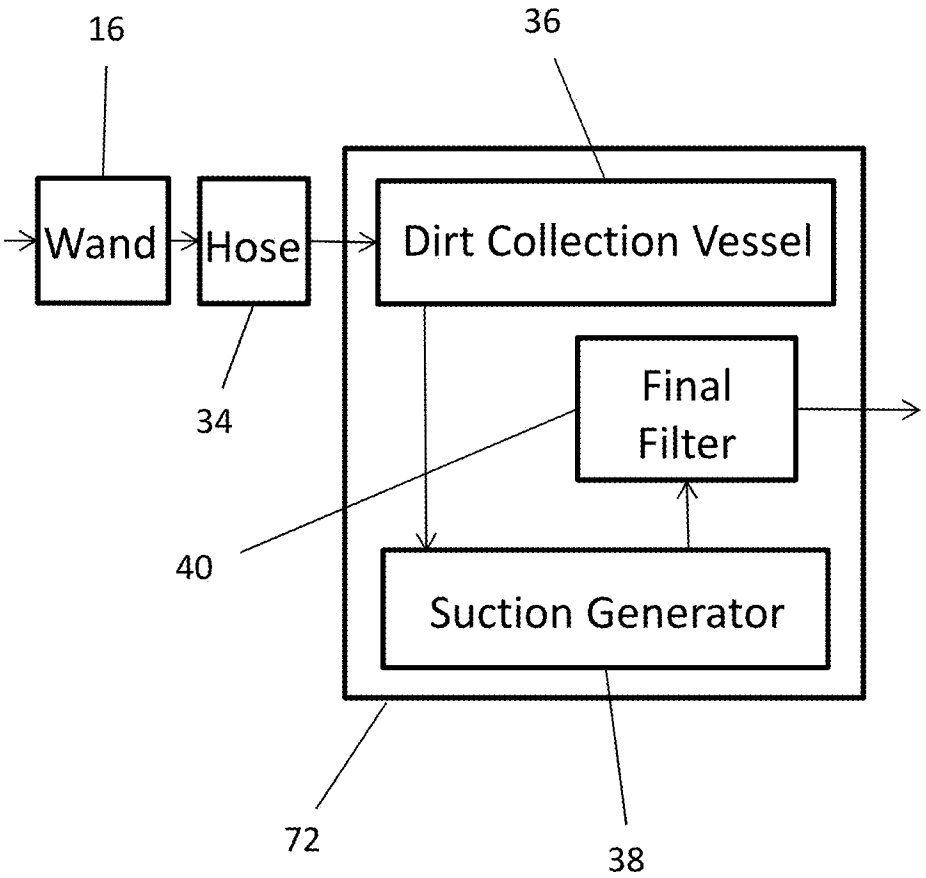

Reference is now made to FIGS. 3 and 3*a* illustrating the upright vacuum cleaner in a second auxiliary operating mode. In this configuration, only the cleaning wand 16 is removed from the home position on the body of the vacuum cleaner and manipulated by an operator to complete the desired cleaning application. The supplemental cleaning tool 32 remains connected to the body of the vacuum cleaner in the home position. Again, this is accomplished without any need to handle the supplemental cleaning tool 32. In this configuration or mode of operation, dirt and debris are directly drawn into the open end of the cleaning wand 16 and travel by way of the flexible hose 34 to the dirt collection vessel 36. From there the air flows through the suction generator 38 and is then exhausted through the final filter 40.

Figure 4:
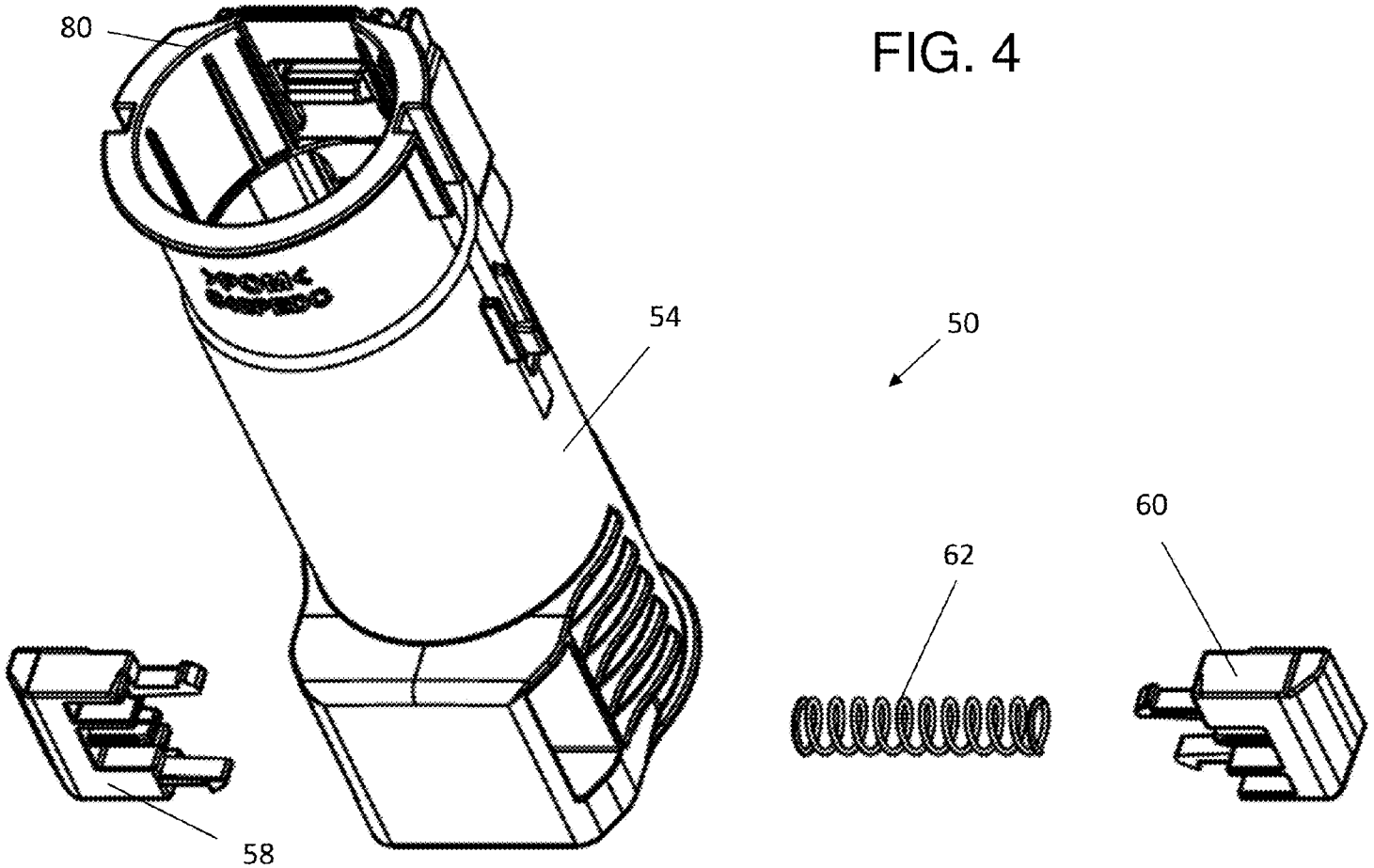
FIG. 4 is a detailed, exploded perspective view of the latch that secures the cleaning wand to the body of the vacuum cleaner.

Reference is now made to FIGS. 4-9 illustrating the wand release which includes the latch 50 and the latch release 52. As best illustrated in FIG. 4, the latch 50 includes a housing member 54 that holds opposed, spring-loaded latching bolts 58, 60 that are biased outwardly by the coil spring 62.

Figure 5:
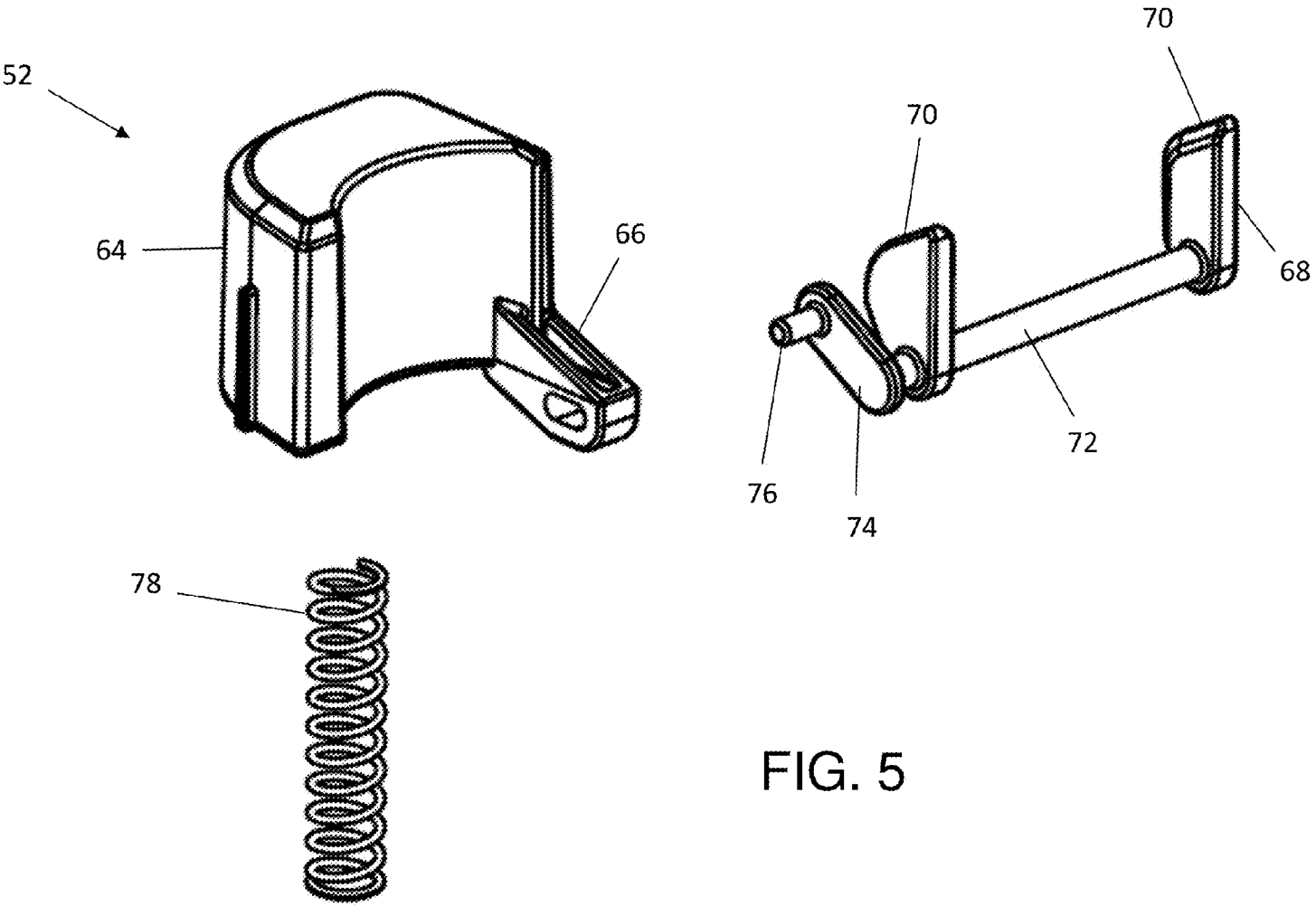
FIG. 5 is a detailed, exploded perspective view of the latch release that is used to release the latch and remove the wand from the body of the vacuum cleaner.
Figure 6:
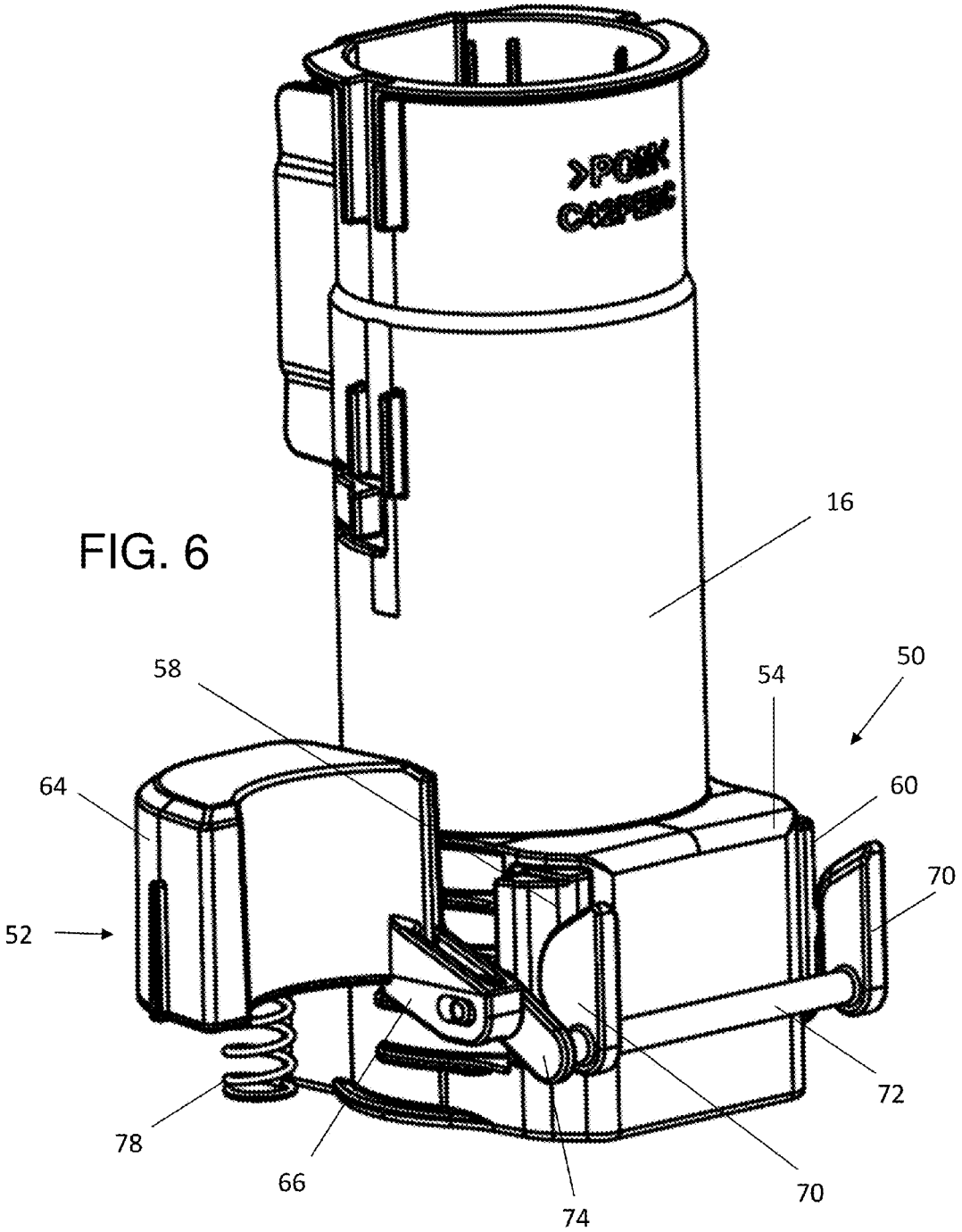
FIG. 6 illustrates the relative positions of the latch and latch release when the wand is locked to the body of the vacuum cleaner.
Figure 7:
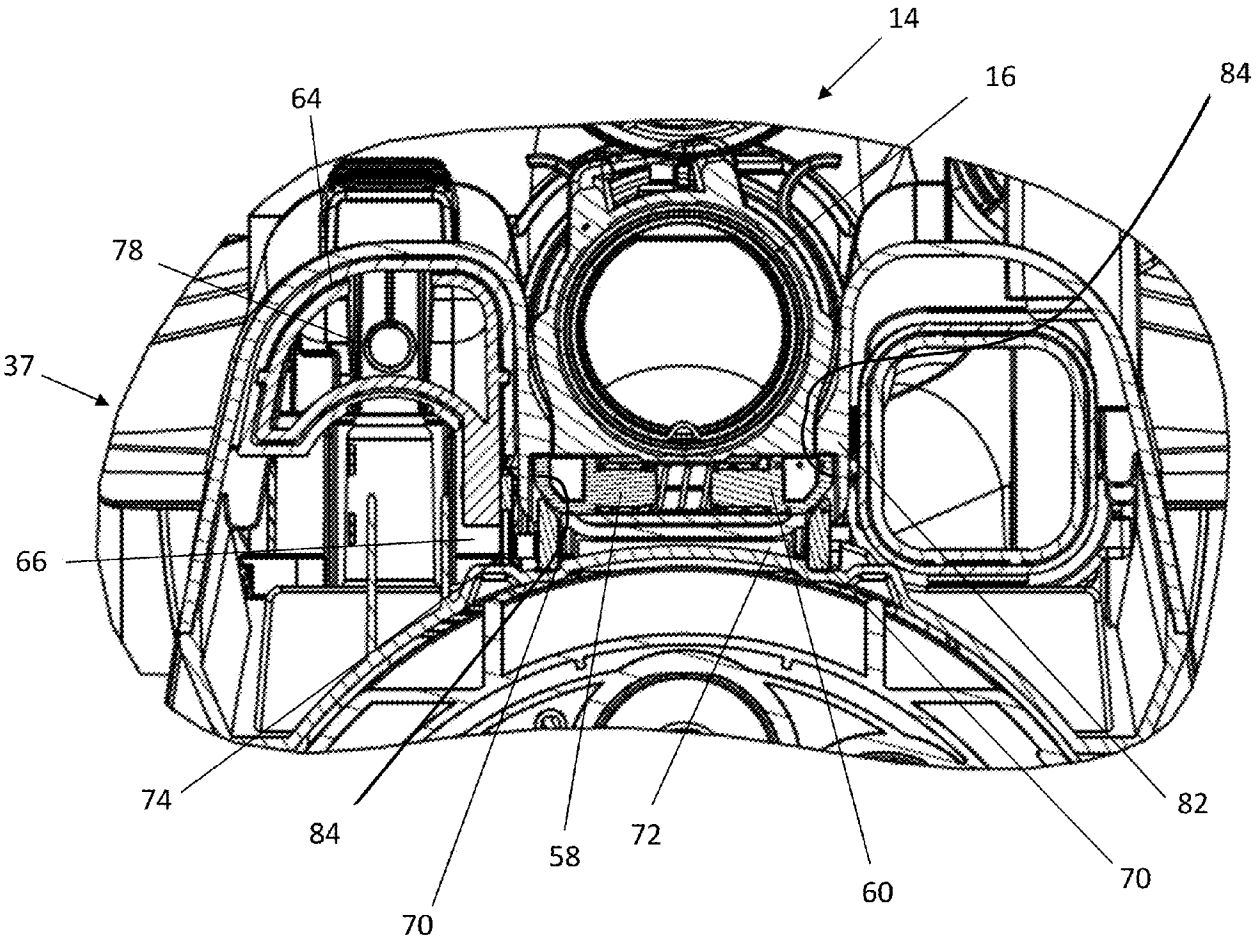
FIG. 7 is a cross-sectional view illustrating how the spring-loaded latching bolts of the latch are received in the opposed latching slots on the body when the wand is secured to the body of the vacuum cleaner.
Figure 8:
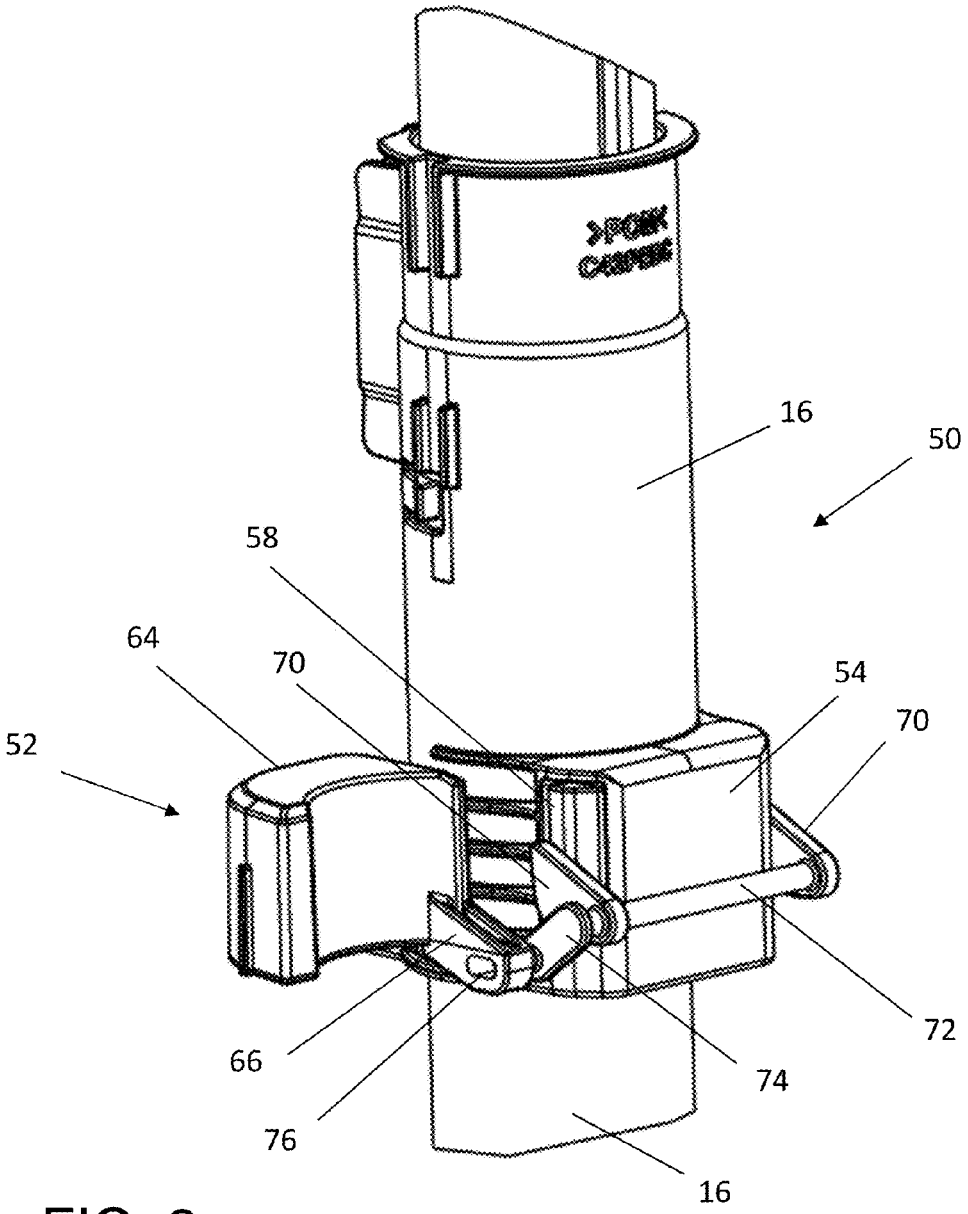
FIG. 8 illustrates the relative position of the latch and latch release when the latch release is activated to release the wand from the body of the vacuum cleaner.
Figure 9:
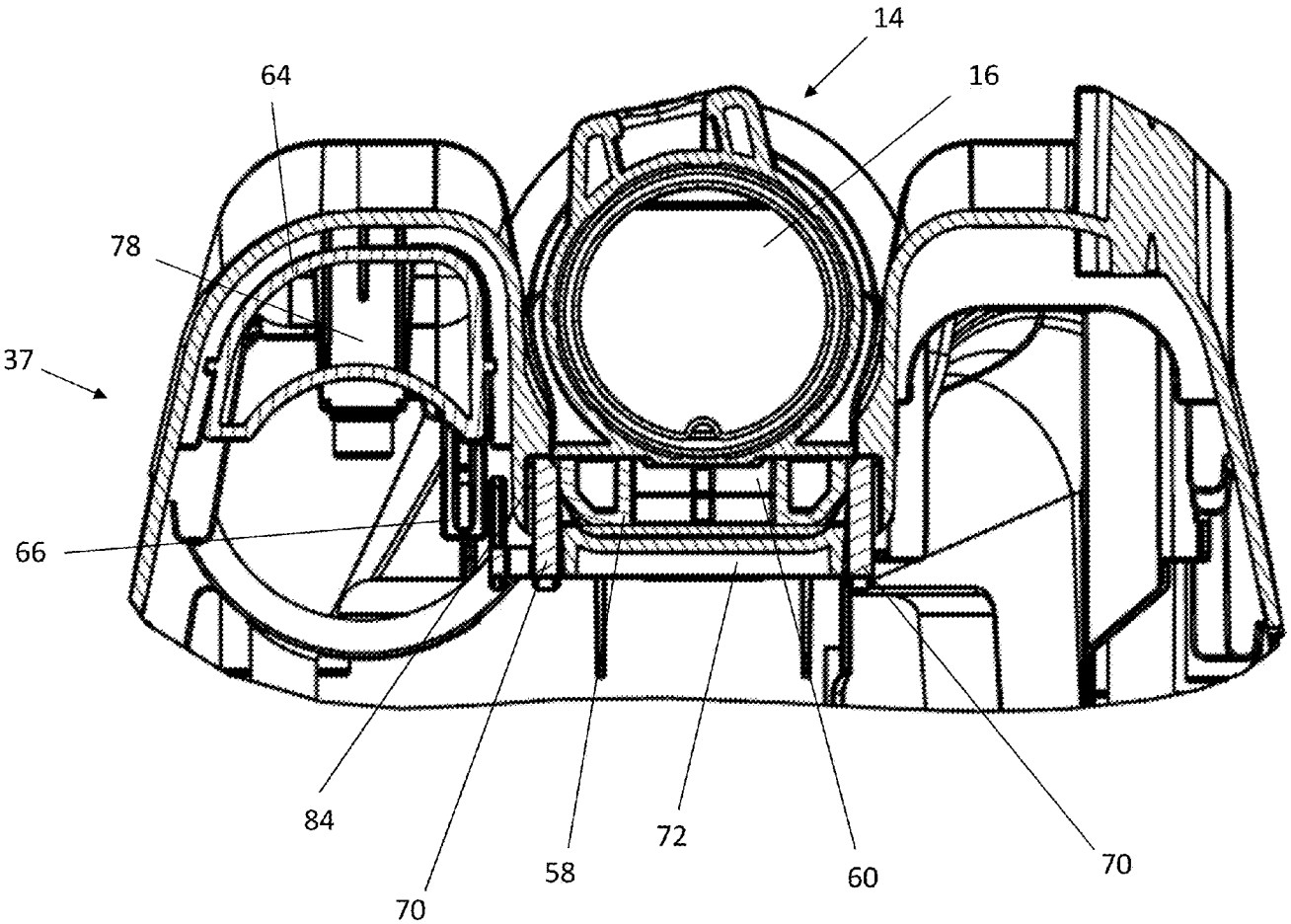
FIG. 9 is a cross-sectional view illustrating how the pivot cams of the latch release engage the latching bolts and effectively withdraw them from the cooperating opposed latching slots to allow the removal of the wand assembly from the body of the vacuum cleaner.

As illustrated in FIG. 5, the latch release 52 includes the push button actuator 64 having an integral lever 66 and the pivoting cam 68. Pivoting cam 68 includes two cam paddles 70 connected by the cross-member 72 and an integral lever 74 connected by the tab 76 to the lever 66 of the actuator 64. A coil spring 78 biases the actuator 64 and the pivoting cam 68 to a home position illustrated in FIGS. 6 and 7. In one possible embodiment, the latch 50 is mounted on the wand 16 which extends through the opening 80. In contrast, the latch release 52 is mounted on the body of the vacuum cleaner 10 and, more particularly, the frame 82 of the handle assembly 14. As best illustrated in FIGS. 6 and 7, when in the home position, the coil spring 62 biases the latch bolts 58, 60 outwardly into the cooperating opposed latching slots 84 provided in the frame 82 of the canister housing 37. Thus, in the normal position, the latch 50 secures the wand 16 to the body/frame 82 of the handle assembly 14.

When the operator wishes to configure the vacuum cleaner for use in either of the first or second auxiliary operating modes, the operator depresses the actuator 64. This causes the pivoting cam 68 to pivot so that the paddles 70 engage the latch bolts 58, 60 displacing them inwardly against the action of the coil spring 62 until those bolts are completely withdrawn from the cooperating latching slots 84. Here it should be appreciated that the rounded cam surfaces of the paddles 70 and the rounded cam surfaces on the latch bolts 58, 60 ensure smooth, trouble-free operation.

Once the bolts 58, 60 are removed from the cooperating latching slots 84, the operator may pivot the wand 16 downwardly away from the canister housing 37 as illustrated by action arrow A in FIG. 10*b* so that the top end or cuff 90 of the supplemental cleaning tool 32 is removed from the resilient clip 92 anchored to the handle assembly frame 82 (compare FIGS. 10*a* and 10*b*). The wand 16 is then lifted upwardly as illustrated by action arrow B in FIG. 10*c* to then remove the wand 16 with the cleaning tool 32 secured to the end of the wand. The operator is then free to utilize the vacuum cleaner 10 in the first auxiliary configuration wherein dirt and debris is sucked into the vacuum cleaner through the cleaning tool 32 on the end of the wand 16.

After the operator completes the special cleaning application with the wand 16 and the supplemental cleaning tool 32, the operator manipulates the cleaning tool 32 so as to seat it on the cleaning tool mounting boss 93. More specifically, the seal 95 surrounding the open end of the mounting boss 93 is captured between the mounting boss and the suction inlet 97 on the cleaning tool 32. This seals the air pathway so that air entrapped with dirt and debris may be drawn by the suction generator 38 from the agitator cavity 26, through the suction inlet 30 and the internal conduit 99 in the mounting boss 93, the suction inlet 97 of the cleaning tool 32 and then through the wand 16 and flexible hose 34 to the dirt collection vessel 36 during normal upright vacuum cleaner operation. As this is done it should be appreciated that the cuff 90 is simultaneously snapped into the resilient clip 92 and the latching bolts 58, 60 are simultaneously brought into engagement with the latching slots 84 to complete the reconnection of the wand 16 and supplemental cleaning tool 32 to the handle assembly 14.

Figure 11A:
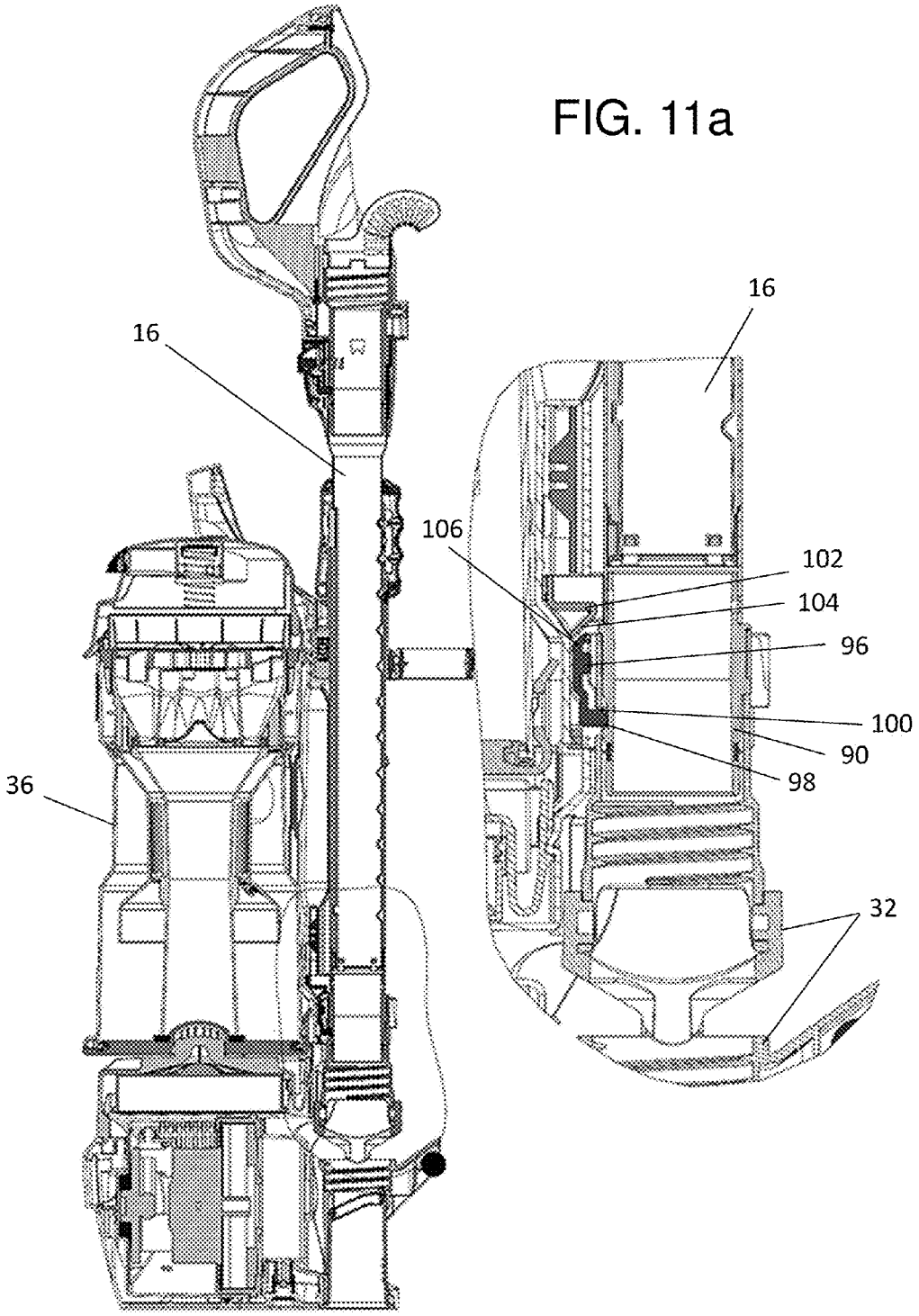

In contrast, if the operator wishes to utilize the vacuum cleaner in the second auxiliary configuration, the operator does not pivot the wand rearwardly from the vacuum cleaner as illustrated in FIG. 10*b*. Instead, as illustrated in FIG. 11*a*, after depressing the actuator 64, the operator lifts the wand 16 upwardly without pivoting. As this is done, the resilient clip 92 around the cuff 90 of the cleaning tool 32 tends to bias the cleaning tool in the direction of action arrow C so that the cleaning tool will be maintained in the home position on the body of the vacuum cleaner 10 and the wand 16 is removed for the cleaning application.

More specifically, as best illustrated in FIGS. 11*a*-11*d*, a tool latch 94 is carried on the cleaning tool 32. The tool latch 94 includes a latch element 96, that is pivotally connected to the supplemental cleaning tool 32 and a latch tab 98 carried on the latch element for engaging a latching notch 100 on the cleaning wand 16. This is the structure that secures the cleaning tool 32 to the wand 16.

As further illustrated in drawing FIGS. 11*a*-11*d*, the vacuum cleaner 10 also includes a tool latch actuator 102 carried on the body and, more particularly, the frame 82 of the handle assembly 14. In the illustrated embodiment, the latch actuator 102 is a static lug or cam.

Figure 11B:
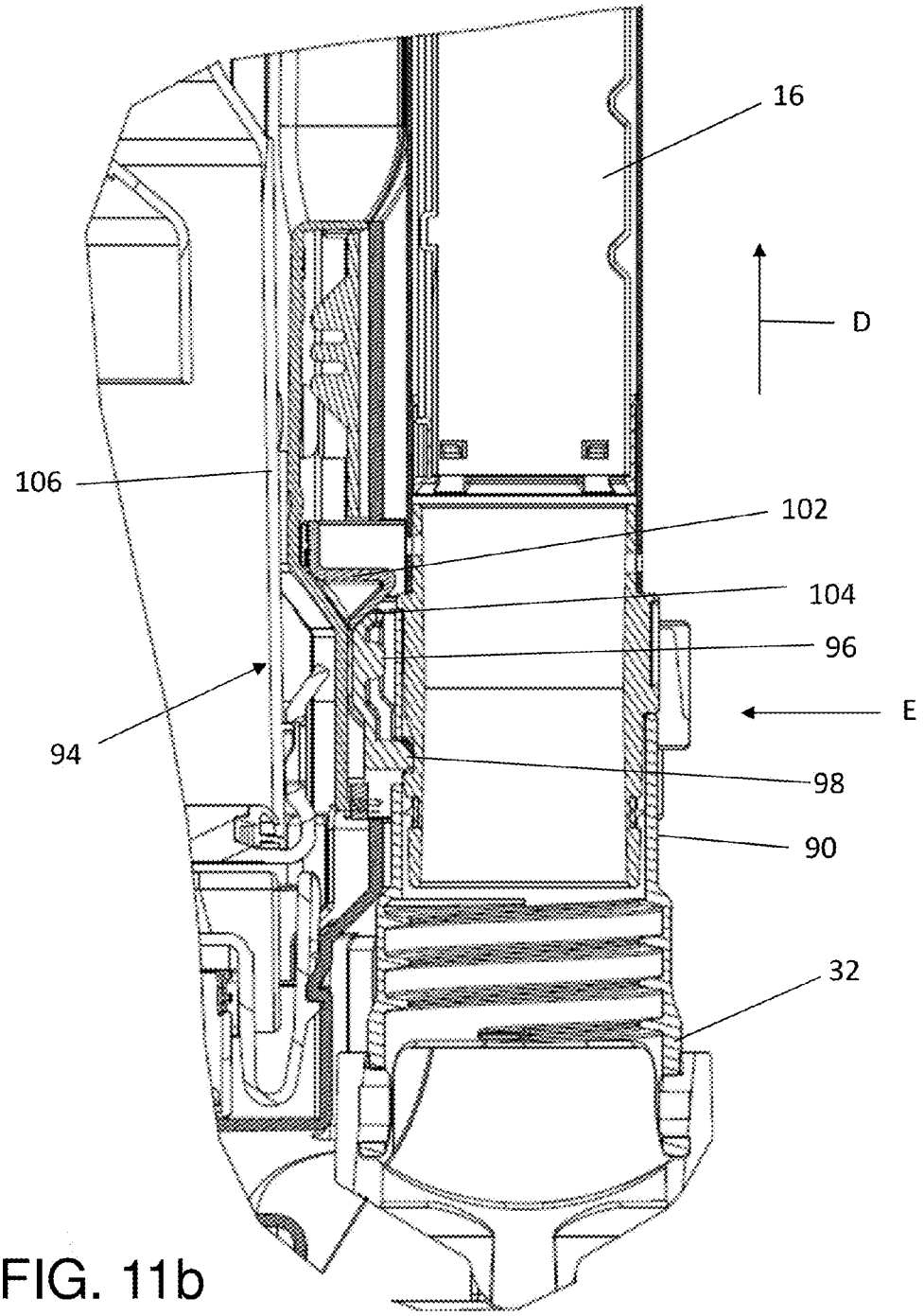
Figure 11C:
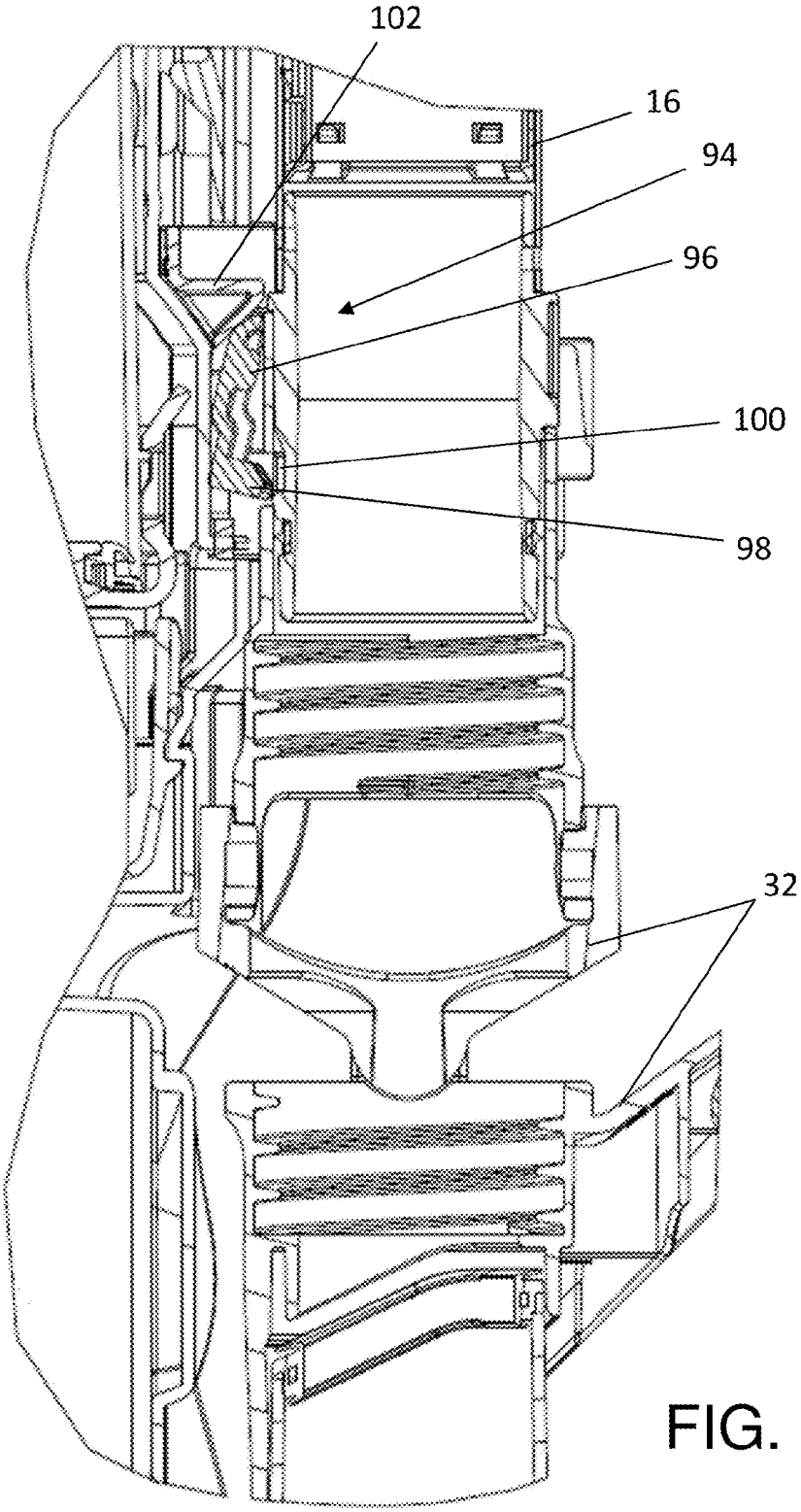
Figure 11D:
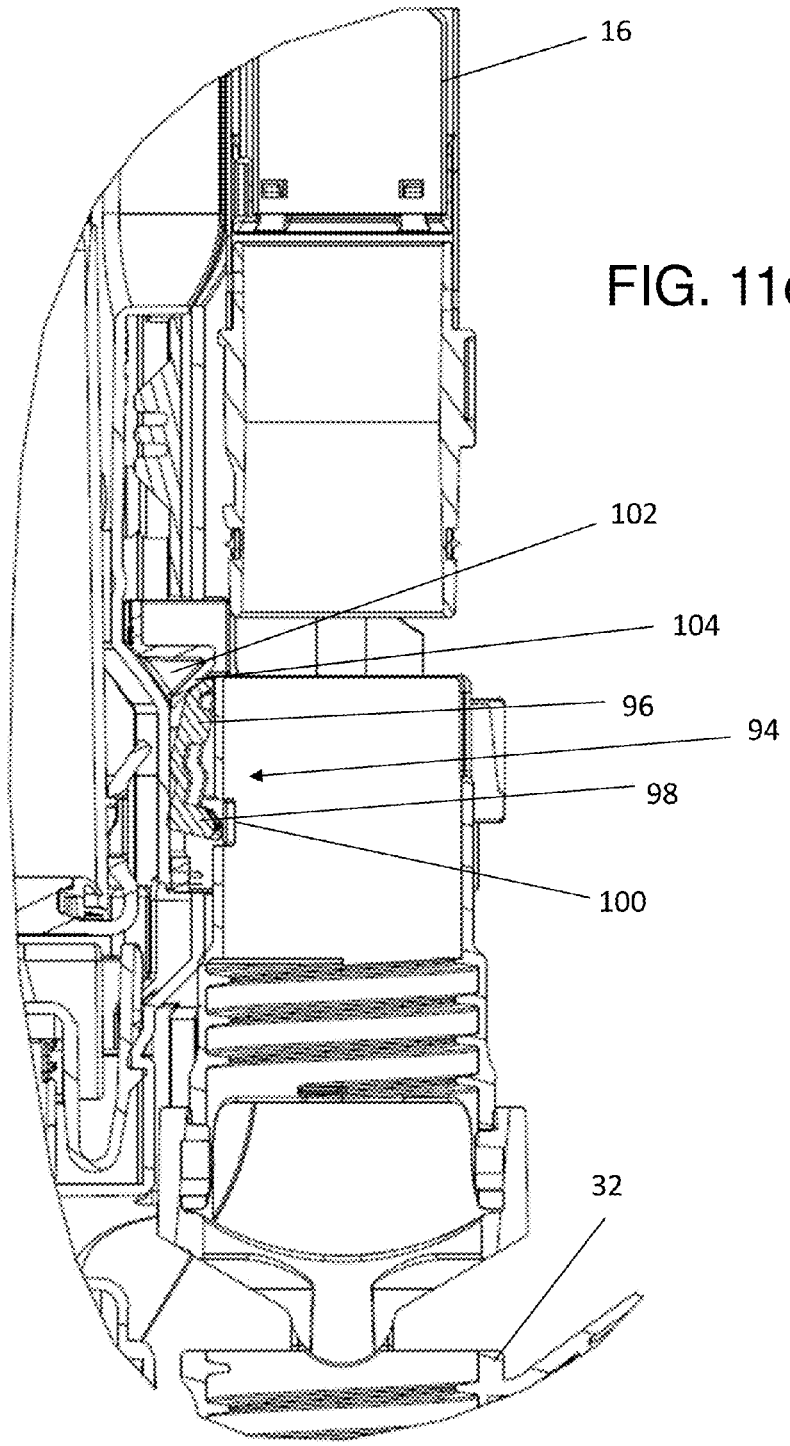

As the wand assembly 34 is lifted upwardly relative to the handle assembly 14 as indicated by the action arrow D in FIG. 11*b*, the resilient clip 92 biases the cleaning tool 32 in the direction of action arrow E so that the latch element 96 is engaged by the tool latch actuator 102. More particularly, the inclined face 104 of the tool latch actuator 102 engages the sloped face 106 of the latch element 96 so that the latch element is pivoted against the biasing force of the spring (not shown) and the latch tab 98 is removed from the latch notch 100 in the wand 16. This serves to disconnect the cleaning tool 32 from the wand 16 allowing the wand 16 to be removed from the handle assembly for cleaning applications while the cleaning tool 32 is simultaneously retained in the home position on the handle assembly 14 by the resilient clip 92 (see FIGS. 11*d* and 12). After completing the specialty cleaning application, the wand 16 may be returned to the home position on the handle assembly 14 by simply inserting the open end of the wand 16 into the open end of the cleaning tool on the handle assembly 14. The wand is moved downwardly until the latch tab 98 again engages in the latch notch 100 to secure the cleaning tool to the wand and the latch bolts 58, 60 are again received in the cooperating latching slots 84 in the frame 82 of the handle assembly to lock the wand in the home position.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. An upright vacuum cleaner, comprising:

a body;

a dirt collection vessel carried on said body;

a suction generator carried on said body;

a cleaning wand releasably held in a home position on said body;

a supplemental cleaning tool attached to a distal end of said cleaning wand when said cleaning wand is in said home position;

a first auxiliary operating mode wherein said cleaning wand and supplemental cleaning tool are removed together from said home position for use in a cleaning application; and a second auxiliary operating mode wherein said cleaning wand is removed from said home position for use in a cleaning application and said supplemental cleaning tool is retained in said home position on said body.

2. The vacuum cleaner of claim 1, wherein said body includes a nozzle assembly connected to a handle assembly.

3. The vacuum cleaner of claim 2, wherein said nozzle assembly includes a suction inlet and in a normal operating configuration air is moved by said suction generator serially through said suction inlet, said supplemental cleaning tool, said cleaning wand and said dirt collection vessel.

4. The vacuum cleaner of claim 3, wherein in said first auxiliary operating mode air is moved by said suction generator serially through said supplemental cleaning tool, said cleaning wand and said dirt collection vessel bypassing said suction inlet in said nozzle assembly.

5. The vacuum cleaner of claim 4, wherein in a second auxiliary operating mode air is moved by said suction generator serially through said cleaning wand and said dirt collection vessel bypassing said supplemental cleaning tool and said suction inlet in said nozzle assembly.

6. The vacuum cleaner of claim 2, further including a cleaning tool mounting boss upon which said supplemental cleaning tool is held when in said home position.

7. The vacuum cleaner of claim 6, wherein said cleaning tool mounting boss also forms a conduit for directing air from a suction inlet in said nozzle assembly to said cleaning wand when said cleaning wand is in said home position.

8. The vacuum cleaner of claim 7, wherein said air directed from said cleaning tool mounting boss to said cleaning wand passes through said supplemental cleaning tool.

9. The vacuum cleaner of claim 8, wherein said cleaning tool mounting boss includes an open end surrounded by a seal.

10. The vacuum cleaner of claim 9, wherein said supplemental cleaning tool includes a suction inlet configured to seat on said open end of said cleaning tool mounting boss with said seal in engagement with said supplemental cleaning tool so as to seal an air pathway between said cleaning tool mounting boss and said supplemental cleaning tool.

11. The vacuum cleaner of claim 1, further including a wand release whereby triggering said wand release allows an operator to initiate either of said first auxiliary operating mode or said second auxiliary operating mode.

12. The vacuum cleaner of claim 1, further including a wand release having a first latch securing said cleaning wand to said body.

13. The vacuum cleaner of claim 12, wherein said first latch includes opposed, spring loaded latching bolts carried on said cleaning wand and cooperating opposed latching slots on said body.

14. The vacuum cleaner of claim 13, wherein said wand release further including a first latch release carried on said body.

15. The vacuum cleaner of claim 14, wherein said first latch release includes a spring loaded actuator and a pivoting cam, whereby triggering said actuator pivots said cam so as to engage said latching bolts and withdrawn said latching bolts from said latching slots to release said cleaning wand from said home position.

16. The vacuum cleaner of claim 15, further including a tool latch securing said supplemental cleaning tool to said distal end of said wand.

17. The vacuum cleaner of claim 16, wherein said tool latch includes (a) a latch element pivotally connected to said supplemental cleaning tool and (b) a latch tab on said latch element for engaging a latching notch on said cleaning wand.

18. The vacuum cleaner of claim 17, further including a tool latch actuator on said body that engages said tool latch and releases said tool latch element and releases said tool latch in said second auxiliary operating mode.

19. The vacuum cleaner of claim 18, further including a resilient clip carried on said body that engages said supplemental cleaning tool when in said home position.

20. A method of selectively operating an upright vacuum cleaner in either of two different auxiliary operating modes wherein said vacuum cleaner includes a body, a cleaning wand releasably held in a home position on said body and a supplemental cleaning tool attached to a distal end of said cleaning wand when said cleaning wand is in said home position, said method comprising:

triggering a wand release;

moving said cleaning wand in a first manner to remove said cleaning wand and supplemental cleaning tool together from said home position for use in a cleaning application; or moving said cleaning wand in a second manner to remove said cleaning wand from said home position for use in a cleaning application while maintaining said supplemental cleaning tool in said home position on said body.

* * * * *